United States Patent [19]

Boyer et al.

[11] Patent Number: 4,473,464

[45] Date of Patent: Sep. 25, 1984

[54] METHOD FOR PRODUCING DISTILLABLE HYDROCARBONACEOUS FUELS AND CARBONACEOUS AGGLOMERATES FROM A HEAVY CRUDE OIL

[75] Inventors: Lyndon D. Boyer; Matthew C. Sooter; Francis E. Sage, all of Ponca City, Okla.

[73] Assignee: Conoco Inc., Ponca City, Okla.

[21] Appl. No.: 147,455

[22] Filed: May 7, 1980

[51] Int. Cl.[3] ..... C10G 9/32

[52] U.S. Cl. ..... 208/126; 208/106; 48/211

[58] Field of Search ..... 208/106, 126; 48/211

[56] References Cited

U.S. PATENT DOCUMENTS

| | | | |
|---|---|---|---|
| 2,844,521 | 7/1958 | Jahnig | 208/126 |
| 2,855,361 | 10/1958 | Schutte | 208/126 |
| 2,910,427 | 10/1959 | Cabbage | 208/126 |
| 3,401,089 | 9/1968 | Friedrich et al. | 201/6 |
| 4,180,455 | 12/1979 | Taciuk | 208/126 |

*Primary Examiner*—Delbert E. Gantz
*Assistant Examiner*—O. Chaudhuri
*Attorney, Agent, or Firm*—Richard W. Collins

[57] ABSTRACT

In a method for producing a distillable hydrocarbonaceous stream and carbonaceous agglomerates from a heavy crude oil by charging the crude oil and finely divided carbonaceous solids to a rotary kiln with the crude oil and carbonaceous solids being charged in a weight ratio from about 0.6 to about 1.5; tumbling the crude oil and finely divided carbonaceous solids in the rotary kiln at a temperature from about 850° to about 1000° F. for up to about 30 minutes to produce a vaporous stream and agglomerate particles containing a residual portion of the crude oil and finely divided carbonaceous solids; separating the agglomerate particles into a product portion of a desired particle size range and a recycle portion; grinding the recycle portion to produce the finely divided carbonaceous solids and heating the finely divided carbonaceous solids prior to recycling the carbonaceous solids to mixture with the crude oil, an improvement comprising: supplying at least a major portion of the heat required in said rotary kiln by heating the crude oil charged to the rotary kiln thereby eliminating the heating of the finely divided carbonaceous solids prior to recycling.

7 Claims, 1 Drawing Figure

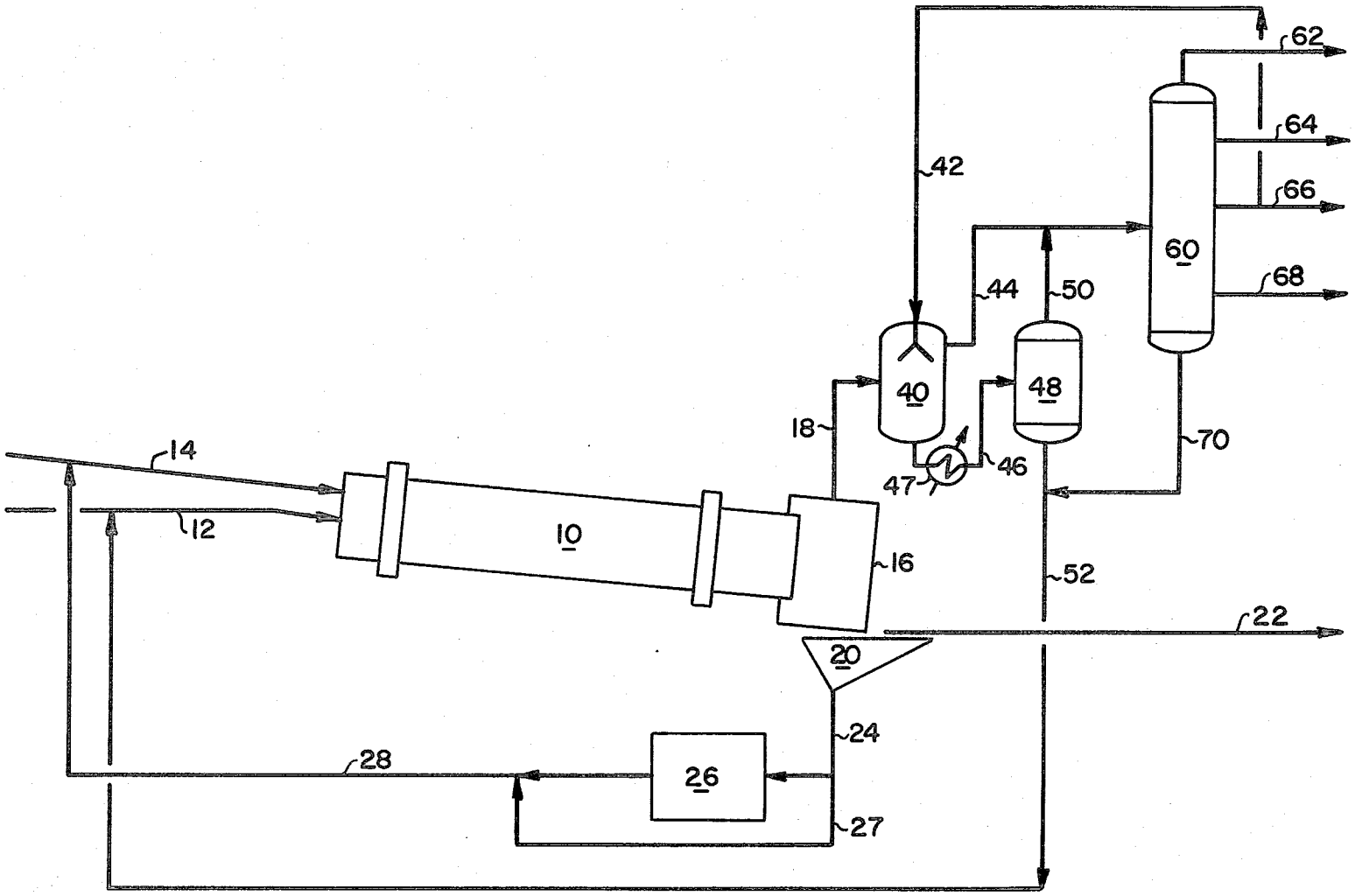
62
64
66
68
60
70
22
50
48
52
44
46
42
40
47
16
20
24
27
18
26
10
28
14
12

METHOD FOR PRODUCING DISTILLABLE HYDROCARBONACEOUS FUELS AND CARBONACEOUS AGGLOMERATES FROM A HEAVY CRUDE OIL

This invention relates to methods for producing distillable fuels and agglomerate solids from heavy crude oils.

In view of the recent well publicized shortage of crude oils worldwide and the continuing demand for distillable fuel products, a continuing search has been underway for some time into alternate sources for distillable fuels. One such source which is readily available, is heavy hydrocarbonaceous material such as that present in tar sands, shale oil, heavy crude oil field deposits and the like hereinafter referred to as heavy crude oil. Previously such heavy crude oils have not been widely used as a feedstock to processes for producing distillable fuels since they are difficult to process and result in the production of substantial quantities of residual materials which tend to coke. While some such crude oils have been processed using existing refinery technology, many such crude oils are so heavy and so high in sulfur and heavy metals that they have not been used as refinery feedstocks. Limited use has been made of such oils in some instances as a feedstock to delayed coking operations and the like.

The following patents were considered in the preparation of this application:

U.S. Pat. No. 2,561,334 issued 7/24/51 to Bowles et al.
U.S. Pat. No. 2,575,587 issued 11/20/51 to Davies
U.S. Pat. No. 2,824,047 issued 2/18/58 to Gorin et al.
U.S. Pat. No. 2,843,533 issued 7/15/58 to Smith et al.
U.S. Pat. No. 2,916,432 issued 12/8/59 to McNamara
U.S. Pat. No. 3,073,751 issued 1/15/63 to Gorin et al.
U.S. Pat. No. 3,077,439 issued 2/12/63 to Shea et al.
U.S. Pat. No. 3,401,089 issued 9/10/68 to Friedrich et al.
U.S. Pat. No. 3,427,240 issued 2/11/69 to Landrum et al.
U.S. Pat. No. 3,562,783 issued 2/9/71 to Gorin
U.S. Pat. No. 3,565,766 issued 2/23/71 to Eddinger et al.
U.S. Pat. No. 3,671,401 issued 6/20/72 to Gorin
U.S. Pat. No. 3,770,418 issued 11/6/73 to Wilde
U.S. Pat. No. 3,803,023 issued 4/9/74 to Hamner
U.S. Pat. No. 3,873,427 issued 3/25/75 to Long et al.
U.S. Pat. No. 4,008,054 issued 2/15/77 to Clancey et al.
U.S. Pat. No. 4,030,982 issued 6/21/77 to Gorin et al.
U.S. Pat. No. 4,039,319 issued 8/2/77 to Schapiro et al.
Canadian Pat. No. 880,884 issued 9/14/71 to Masologites et al. British Pat. No. 1,310,735 published 3/21/73 to Hydrocarbon Research Inc.

As a result of the increasing price of crude oil and the continuing demand for distillable fuels, the search continues for methods for converting such heavy crude oils into distillable products.

It has been found that such heavy crude oils are converted into distillable products and metallurgical grade coke or gasifier feedstock by a method which consists essentially of charging the crude oil and finely divided carbonaceous solids to a rotary kiln with the crude oil and finely divided carbonaceous solids being charged to the rotary kiln in a weight ratio of crude oil to carbonaceous solids from about 0.6 to about 1.5; tumbling the crude oil and the finely divided carbonaceous solids in the rotary kiln at a temperature from about 850° to about 1000° F. (about 450° to about 540° C.) for up to about 30 minutes to produce a vaporous stream and agglomerate particles containing a residual portion of the crude oil and finely divided carbonaceous solids; separating the agglomerate particles into a product portion of a desired particle size range and a recycle portion; grinding the recycle portion to produce finely divided carbonaceous solids and heating the finely divided carbonaceous solids to a temperature sufficient to result in a temperature from about 850° to about 1000° F. (about 450° to about 540° C.) in the rotary kiln upon mixing the finely divided solids and the crude oil.

The present invention is directed to an improvement in such a method, the improvement comprising: supplying at least a major portion of the heat required to maintain the temperature in the rotary kiln by heating the crude oil to an elevated temperature for charging to the rotary kiln thereby eliminating the need to heat the recycled finely divided carbonaceous solids. Optionally the carbonaceous solids may be recycled to the rotary kiln without grinding.

The FIGURE is a schematic diagram of an embodiment of the process of the present invention.

In the FIGURE, a crude oil stream and a finely divided carbonaceous solid stream are charged to a rotary kiln 10 through a line 12 and a line 14 respectively. The blend of crude oil and finely divided carbonaceous solids which are hereinafter referred to as char are tumbled in rotary kiln 10 for up to about 30 minutes at a temperature from about 850° to about 950° F. (about 450° to about 510° C.). As a result of the tumbling in rotary kiln 10, agglomerate particles are produced and recovered from the discharge end of rotary kiln 10 on a screen 20. Rotary kiln 10 is desirably sealed and operates at a slight positive pressure so that the atmosphere in rotary kiln 10 is non-oxidizing. A seal 16 is shown about the discharge end of rotary kiln 10 to prevent the escape of vapors therefrom. A vaporous stream is recovered from the discharge end of rotary kiln 10 through a line 18 and passed to further processing as will be discussed further hereinafter. The agglomerate particles consisting of a residual portion of the crude oil and finely divided char are recovered on screen 20 and separated into a portion of a desired size range which is recovered through a line 22 and constitutes a solids product stream of the process and an undersize or recycle portion which is recovered through a line 24 and passed to a grinder 26. The undersize portion is ground to a desired size in grinder 26 and passed through a line 28 to recycle to rotary kiln 10 via line 14. The undersize portion is typically ground to a size less than about 8 Tyler mesh since it has been found that it is necessary to charge finely divided carbonaceous solids to rotary kiln 10 in order to obtain strong agglomerates in rotary kiln 10 as discussed in U.S. Pat. No. 3,401,089. Crude oil and finely divided char are passed to rotary kiln 10 in a weight ratio of crude oil to char of about 0.6 to about 1.5. Considerable variation in the proportions of crude oil and char is possible depending upon the particular crude oil used and the possible presence of diluents in the crude oil to facilitate handling. The crude oil should be charged in proportions such that from about 15 to about 40 weight percent, and preferably 25 to 35 weight percent, of the agglomerate particles produced consists of residual portions of the crude oil. Such is desirable to ensure proper binding of the finely divided char to produce the agglomerates. Desirably the crude oil is heated to an elevated temperature for charging to rotary kiln 10 to supply at least a major portion of the heat required to maintain the desired temperature in rotary kiln 10. The blend of finely divided char and crude oil in rotary kiln 10, as indicated previously, should be at a temperature from about 850° to about 950° F. (from about 450° to about 510° C.). The temperature in rotary kiln 10 is accomplished by properly adjusting the temperature of the stream of crude oil and the stream of finely divided char charged to rotary kiln 10. The char is desirably not subjected to cooling beyond normal heat losses resulting from the screening, grinding and recycle operations. The recycled char will typically be at a temperature somewhat below the desired operating temperature in rotary kiln 10 as recycled. By the improvement of the present invention, the crude oil charged to rotary kiln 10 is heated to a temperature sufficiently in excess of the desired temperature in rotary kiln 10 to result in a mixture of crude oil and char in rotary kiln 10 at the desired temperature after mixing. Such eliminates the needs for solids heating facilities in the process.

The crude oil is heated to temperatures in excess of the desired operating temperature up to temperatures at which heating vessel coking, etc. begin to constitute a problem. For most crude oils contemplated temperatures of about 900° to about 1000° F. (about 480° to about 540° C.) are considered suitable. A typical crude oil will be heated to a temperature of about 950° F. (about 510° C.). These temperatures are typically reached for only a few seconds in the heating furnace. Longer times tend to result in undesirable coking and cracking in the furnace rather than in the rotary kiln as planned. When metallurgical grade coke is to be produced, the solids stream recovered through line 22 is desirably of a size range from about ¾ inch to about 3 inches, and is optionally passed to a calciner (not shown). When the product stream produced through line 22 is to be used as a feedstock to a gasifier or the like, a size larger than about ¼ inch is suitable.

Typically, from about 60 to about 80 weight percent of the crude oil charged to rotary kiln 10 is recovered as a vaporous stream which typically comprises fuel gases and distillable fuels. The stream is normally recovered from rotary kiln 10 at a temperature from about 850° to about 950° F. (about 450° to about 510° C.) and passed as a vapor to further processing. As will be apparent to those skilled in the art, the agglomerate particles recovered from rotary kiln 10 at the operating temperatures stated are carbonized. The vaporous stream recovered from rotary kiln 10 through line 18 is passed to a vessel 40 where it is countercurrently contacted with an oil stream charged to vessel 40 through a line 42. The oil is desirably sprayed into vessel 40 with the vaporous stream from line 18 countercurrently contacting the oil spray. The vaporous stream is cooled in vessel 40 and a major portion of any entrained solids in the vaporous stream is removed and recovered through a line 46 which passes the liquid stream recovered from vessel 40 through a heater 47 and to a flash vessel 48 where volatile constituents of the stream flowing through line 46 are flashed through a line 50 to further processing. The bottoms stream recovered from vessel 48, which contains the heavier constituents contained in the vaporous stream recovered from rotary kiln 10 and any entrained solids recovered in vessel 40 is optionally recycled through a line 52 and combined with the crude oil charged to rotary kiln 10. The vaporous stream recovered from vessel 40 through a line 44 and the vaporous stream recovered from vessel 48 through line 50 are combined and passed to further processing in a fractionator 60. In fractionator 60 the vaporous stream is separated into a plurality of hydrocarbon fuel streams recovered through lines 62, 64, 66 and 68. Clearly a variety of streams can be recovered or the vaporous stream can be passed in its entirety to further refining. Optionally, a portion of one of the streams recovered from fractionator 60, shown as a portion of the fraction recovered through line 66, is passed to vessel 40 for use in countercurrently contacting the vaporous stream from line 18. Further, a bottoms portion may be recovered from fractionator 60 which will contain heavy constituents of the vaporous stream recovered through line 18 and may contain a minor portion of finely divided solid materials. The recovery of such a stream is shown through a line 70 with the stream recovered through line 70 being recycled and combined with the crude oil charged to rotary kiln 10. Clearly, a variety of options are available to those skilled in the art for the treatment of the vaporous stream recovered through line 18 to produce a variety of distillable and gaseous hydrocarbon fuels. The processing of such a stream is not considered to be a part of the present invention since the present invention is directed to the production of a distillable stream which is readily processed to yield gaseous and distillable hydrocarbon fuels from a heavy crude oil rather than the refinery techniques used to process the vaporous stream recovered through line 18 into the desired products.

While not shown in the FIGURE the stream charged to rotary kiln 10 may be topped or otherwise processed as known to those in the art prior to charging to rotary kiln 10 although it is expected that in most embodiments of the present invention such steps will not be necessary. Such steps can be used if desirable within the scope of the present invention.

When metallurgical grade coke is produced as a product it is necessary that a relatively strong coke be produced to meet the product specifications of coke users. It is normally necessary to grind the recycled char when the production of strong coke is desired. Grinding the recycled char also facilitates the heating of the recycled solids. It may also be necessary to calcine the resulting green coke to meet metallurgical coke users requirements.

When the solids product is to be used as a gasifier feedstock less strength is required. Further smaller solid particles are usable as a product stream with a resulting smaller particle size recycle stream. In such instances the recycle char may be recycled without grinding, as shown via a line 27. While the resulting product is not as strong, such strength is not required in a gasifier feedstock and an operation has been eliminated thus resulting in a substantial savings.

In the practice of the present invention, the heating of the crude oil may be accomplished by means known to those skilled in the art for the heating of such streams. Such techniques are considered to be known to the art and need not be discussed in detail. Similarly the use of an oil spray in vessel 40 while suitably conducted at a temperature from about 300° to about 400° F. (150° to about 205° C.) may be conducted at different temperatures. Similarly a reduced pressure could be used to facilitate the recovery of the volatile constituents of the stream in line 46 in flash vessel 48. Such variations and modifications are considered to be known to those skilled in the art. Further, in the operation of rotary kiln 10, while residence times of up to about 30 minutes are considered to be suitable it is clear that residence times considerably less than 30 minutes and typically from about 10 to about 25 minutes may be suitable in many instances. For instance at the higher temperatures shorter residence times are required. The primary requisite in rotary kiln 10 is that a suitable time be provided to permit the agglomeration of the finely divided carbonaceous solids with the residual portions of the crude oil to produce agglomerates which thereafter carbonize with the crude oil being thermally cracked to produce vaporous constituents which are recovered through line 18. The selection of a suitable residence time is clearly within the skill of those in the art, based upon the feedstreams used.

While the vaporous stream is recovered from the discharge end of kiln 10 in the FIGURE, the vaporous stream can be recovered from either end of kiln 10 or from the middle portions of kiln 10 as shown for instance in U.S. patent application Ser. No. 030,667, filed Apr. 16, 1979 and indicated allowable Feb. 14, 1980. The recovery of the vaporous stream from the middle section of the kiln 10 may be preferred when a high percentage of the crude oil is recovered as a vapor from kiln 10.

Having thus described the invention by reference to certain of its preferred embodiments, it is respectfully pointed out that the embodiments described are illustrative rather than limiting in nature and that many variations and modifications are possible within the scope of the present invention. Such variations and modifications may appear obvious or desirable to those skilled in the art based upon the foregoing description of preferred embodiments.

Having thus described the invention, we claim:

1. In a method for producing fuel gases, a distillable hydrocarbonaceous stream and carbonaceous agglomerates from a heavy crude oil feedstock, said method consisting essentially of (a) charging said crude oil and finely divided carbonaceous solids to a rotary kiln, said crude oil and said finely divided carbonaceous solids being charged in a weight ratio of crude oil to carbonaceous solids from about 0.6 to about 1.50;

(b) tumbling said crude oil and said finely divided carbonaceous solids in said rotary kiln at a temperature from about 850° to about 950° F. (about 450° to about 510° C.) for a residence time up to about 30 minutes to produce a vaporous stream and agglomerate particles containing a residual portion of said crude oil and said finely divided carbonaceous solids;

(c) recovering a product portion of agglomerate particles having a desired particle size; and (d) recovering a recycle portion of agglomerate particles and returning said recycle portion to said rotary kiln;

the improvement comprising heating said crude oil to a temperature of 900° to 1000° F. (about 480° to about 540° C.) prior to introducing said crude oil to said rotary kiln as the only source of heat for the process thereby eliminating the need to subject said recycle portion of agglomerate particles to additional heating prior to returning them to said rotary kiln.

2. The method of claim 1 wherein said recycle portion of agglomerate particles is subjected to grinding prior to being recycled to said rotary kiln.

3. The method of claim 1 wherein said product portion of said agglomerate particles is of a size range from about ¾ inch to about 3 inches and is calcined to provide particles suitable for use as metallurgical grade coke.

4. The method of claim 1 wherein said product portion of said agglomerate particles is of a size greater than about ¼ inch and is suitable as a gasifier feedstock.

5. The method of claim 1 wherein said agglomerate particles contain from about 15 to about 40 weight percent residual portions of said crude oil.

6. The method of claim 1 wherein said vaporous stream is passed to further processing to produce fuel gases and distillable fuels.

7. The method of claim 1 wherein said residence time is from about 10 to about 25 minutes.

* * * * *